US010179415B2

(12) United States Patent
Landwehr

(10) Patent No.: US 10,179,415 B2
(45) Date of Patent: Jan. 15, 2019

(54) HAND CUTTER WITH A RETRACTABLE BLADE

(71) Applicant: Thomas Jay Landwehr, DePere, WI (US)

(72) Inventor: Thomas Jay Landwehr, DePere, WI (US)

(73) Assignee: Ritesafety Products International, LLC, De Pere, WI (US)

( * ) Notice: Subject to any disclaimer, the term of this patent is extended or adjusted under 35 U.S.C. 154(b) by 87 days.

(21) Appl. No.: 15/473,709

(22) Filed: Mar. 30, 2017

(65) Prior Publication Data

US 2018/0281209 A1 Oct. 4, 2018

(51) Int. Cl.
*B26B 1/08* (2006.01)
*B26B 5/00* (2006.01)
*B26B 7/00* (2006.01)

(52) U.S. Cl.
CPC ..... *B26B 1/08* (2013.01); *B26B 5/001* (2013.01); *B26B 5/003* (2013.01); *B26B 7/00* (2013.01)

(58) Field of Classification Search
CPC B26B 1/08; B26B 5/001; B26B 5/003; B26B 7/00
See application file for complete search history.

(56) References Cited

U.S. PATENT DOCUMENTS 994,627 A * 6/1911 Workman ..... F16H 19/04 74/153
3,869,755 A * 3/1975 Stauft ..... A22C 9/008 452/141
4,872,360 A * 10/1989 Lew ..... F01B 9/047 74/110
6,205,667 B1 * 3/2001 Glesser ..... B26B 1/08 30/151
2003/0150117 A1 * 8/2003 Owoc ..... B26B 5/001 30/162
2006/0053631 A1 * 3/2006 Fossella ..... B26B 5/00 30/165
2007/0089301 A1 * 4/2007 Arias ..... B25F 3/00 30/277.4
2007/0101580 A1 * 5/2007 Fossella ..... B26B 5/00 30/162
2008/0262402 A1 * 10/2008 Ogilvie ..... A61F 5/024 602/19
2009/0113725 A1 * 5/2009 DeLillo ..... B26B 5/001 30/335
2010/0212164 A1 * 8/2010 Garavaglia ..... B26B 5/001 30/162
2010/0223793 A1 * 9/2010 Hansen ..... B26B 1/046 30/162
2011/0197516 A1 * 8/2011 Monoi ..... B60H 1/00692 49/425
2016/0167239 A1 * 6/2016 Gallegos ..... B26B 5/001 30/162
2016/0290453 A1 * 10/2016 Rubens ..... B27B 19/006
2018/0186018 A1 * 7/2018 Peyrot ..... B26B 5/001

* cited by examiner

*Primary Examiner* — Sean Michalski

(57) ABSTRACT

A hand cutter comprising a housing, a blade assembly, an actuator assembly, a gear assembly and a retraction means with the gear assembly connecting the actuator assembly to the blade assembly in such a manner that a movement of said actuator slide is transmitted to said blade assembly via said gear assembly with a gear ratio of said gear assembly such that moving said actuator slide moves said blade assembly by a larger distance.

15 Claims, 10 Drawing Sheets

HAND CUTTER WITH A RETRACTABLE BLADE

FIELD OF THE INVENTION

The present invention generally relates to a hand cutter with a retractable blade according to the preamble of patent-claim 1.

BACKGROUND OF THE INVENTION

Hand cutters with safety features for protection are well known and have been present in the market for many years. The need for cutting tools with the highest possible protection for the user is increasing in today's market, where many goods are shipped throughout the world for which the packaging needs to be removed safely and swiftly. Solutions range from low cost devices with integrated blades to more sophisticated hand cutters with replaceable blades. Several means are known for providing safe handling of the cutters, both for when these are in use, as well as when they are not in use. One common solution is to stow the cutting blade within the housing of the cutting tool when it is not in use. The blade is extended out of the housing for cutting before it is used and is stowed away into the housing after its use.

Solutions for such cutting tools include an actuator for extending the blade out of the housing, which is then in an extended position until a cut is made. As soon as pressure is applied during the cutting action the blade and the actuator are decoupled and the blade is then automatically retracted into the housing as soon as the cutting action is finished.

One issue with currently known knives is to provide an extended position in which the blade is not accidentally retracted due to a quick motion or jolt created by the user. Some such knives automatically retract before they were used for cutting due to wear of the parts used in the hand cutter. In addition, when such knives are used for a long period of time, the blade may become stuck in an intermediate position, causing the whole mechanism to fail.

Another common problem with such knives is that due to the complexity required for providing a reliable mechanism for automatically retracting the blade, the distance the blade can be extended is usually limited to the displacement of the trigger mechanism. For example, US 2016/0167239 A1 discloses a hand cutter wherein a slider button assembly is connected to a blade carriage assembly via a single pinion gear. Thus, when the user moves the slider button assembly in one direction by a certain distance, the blade carriage assembly and the blade are moved by the same distance in the opposite direction. Not only is it counter-intuitive that the blade moves forward when the slider button moves backward, but this also requires users to make large movements with the thumb in order to extend the blade by a useful distance when making a deep cut. EP 2 979 828 A1 shows a hand cutter wherein an actuator assembly is connected to a blade assembly via a gear assembly comprising several pinion gears. However in this case the movement of the actuator is in a perpendicular direction to the movement of the blade assembly.

SUMMARY OF THE INVENTION

The main object of the present invention is to provide an improved hand cutter with a retractable blade, which can be easily placed in a stable fully extended position without requiring a large forward motion of the users thumb or other finger and which is automatically retracted and placed back into the original position after performing the cut. This is achieved by providing the hand cutter with an actuator assembly, a gear assembly and a blade assembly which are coupled by respective coupling mechanisms. A movement of the actuator assembly is transmitted to the blade assembly via the gear assembly, whose gear ratio allows the blade to extend from the housing by a larger distance than the movement of the actuator assembly. The blade assembly is decoupled from the gear assembly in the extended position as soon as the blade is forced into the material to cut and is retracted automatically after the cut has been performed.

Another object of the present invention is to provide a means preventing accidental retraction of the blade assembly before the blade has been used and a means enabling a reliable return of the blade assembly and the actuator assembly to the original retracted position without getting stuck. This is achieved by a stabilization assembly included in the rear part of the housing.

DETAILED DESCRIPTION OF THE INVENTION

Figure 1A:
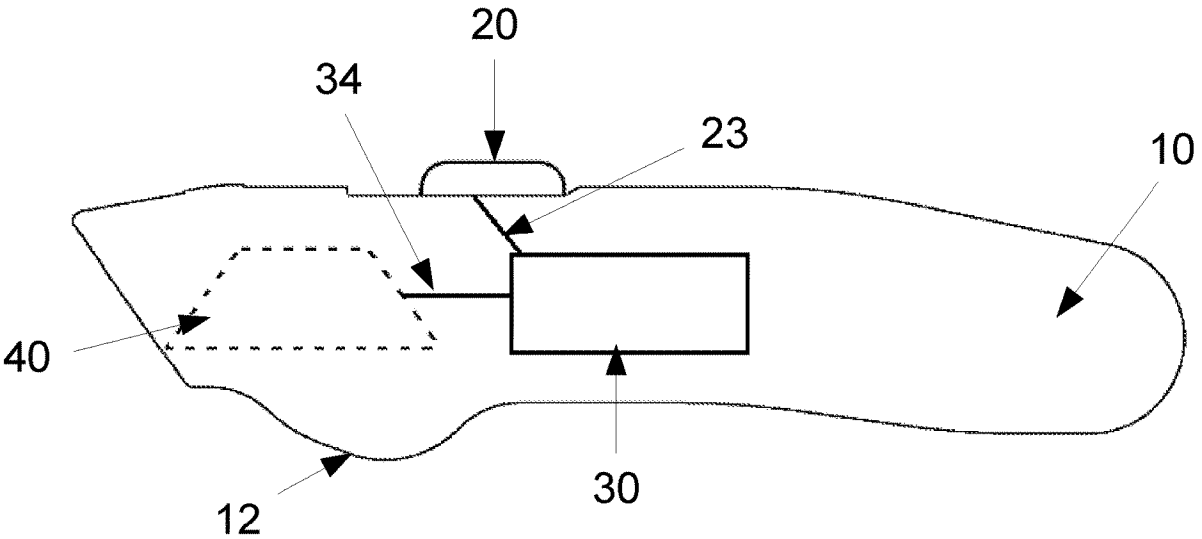
FIG. 1*a* is a functional view of the hand cutter in the retracted position
Figure 1B:
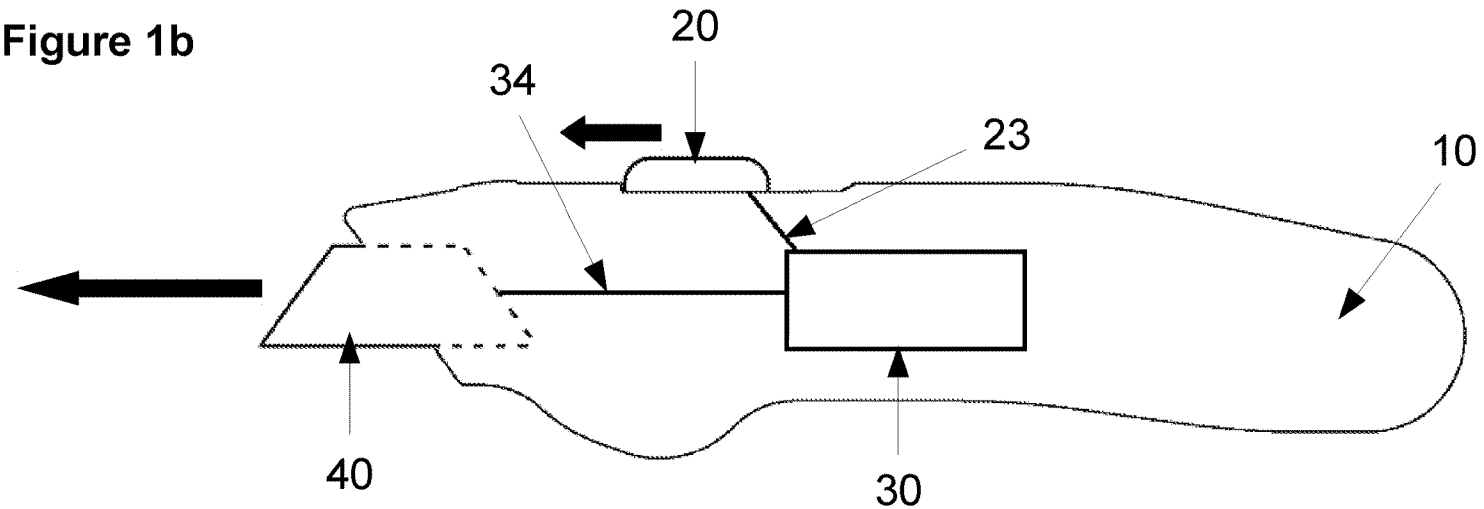
FIG. 1*b* is a functional view of the hand cutter in the extended position

The present hand cutter comprises a housing 10, an actuator assembly 20, a gear assembly 30 and a blade assembly 40 (FIG. 1*a*). The actuator assembly 20 and the gear assembly 30 are releasably coupled via first coupling means 23, and the gear assembly 30 and the blade assembly 40 are releasably coupled via a second coupling means 34. Both actuator assembly 20 and blade assembly 40 are slidable within the housing in the longitudinal direction of the hand cutter (FIG. 1*b*). Thus, the actuator assembly 20 is slidable between a first actuator position at the rear of the hand cutter (FIG. 1*a*) and a second actuator position at the front of the hand cutter (FIG. 1*b*). Similarly, the blade assembly 40 is slidable between a retracted position (FIG. 1*a*) and a first extended position (FIG. 1*b*). When the hand cutter is not in use, the actuator assembly 20 and the blade assembly 40 are in the first and retracted position respectively, and the blade is concealed in the housing (FIG. 1*a*). As soon as the actuator assembly 20 is slid forward from the first actuator position towards the second actuator position, the forward movement of the actuator assembly 20 is transmitted to the gear assembly 30 via the first coupling means 23 and subsequently to the blade assembly 40 via the second coupling means 34, which brings the blade out of the housing (FIG. 1*b*). An essential feature of the present hand cutter is that the gear assembly 30 is such that its gear ratio is greater than 1, i.e. the gear assembly 30 amplifies the forward movement of the actuator assembly 20. So, a small movement of the actuator assembly 20 results in a large movement of the blade assembly 40 (FIG. 1*b*).

Figure 2A:
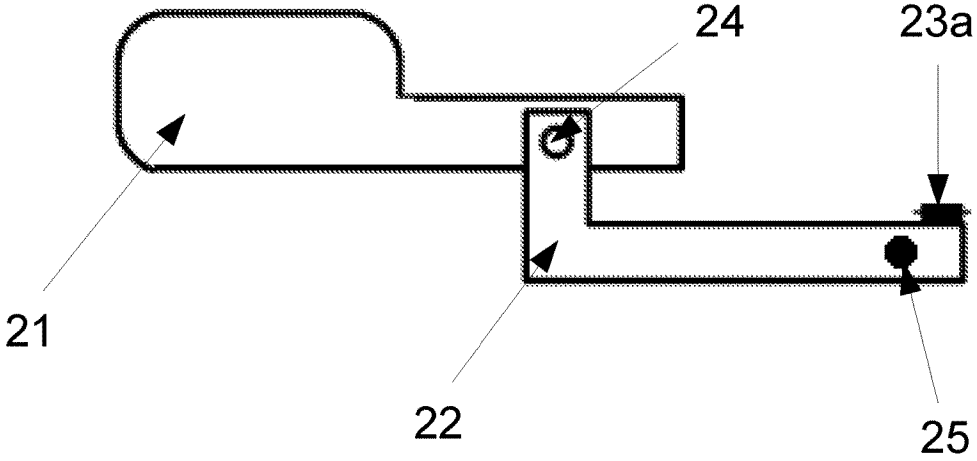
FIG. 2*a-b* is a side view of the actuator assembly
Figure 2B:
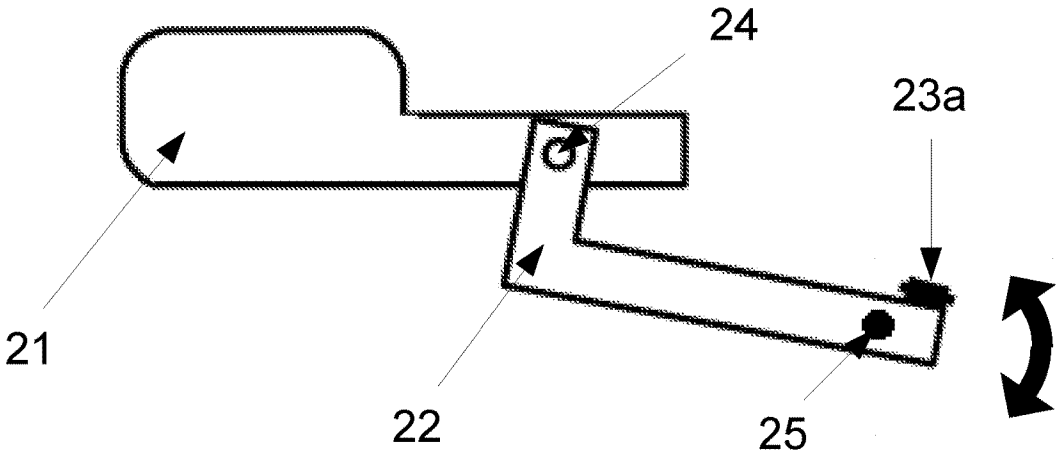

In a preferred embodiment of the present hand cutter, the actuator assembly 20 consists of an actuator slide 21 and a lever arm 22 connected to the actuator slide 21 at a pivot point 24 (FIGS. 2*a-b*). The lever arm 22 is provided with an arm protrusion 23*a* which releasably engages with the gear assembly 30. The lever arm 22 is also provided with an arm knob 25 which engages with the blade assembly 40.

Figure 3A:
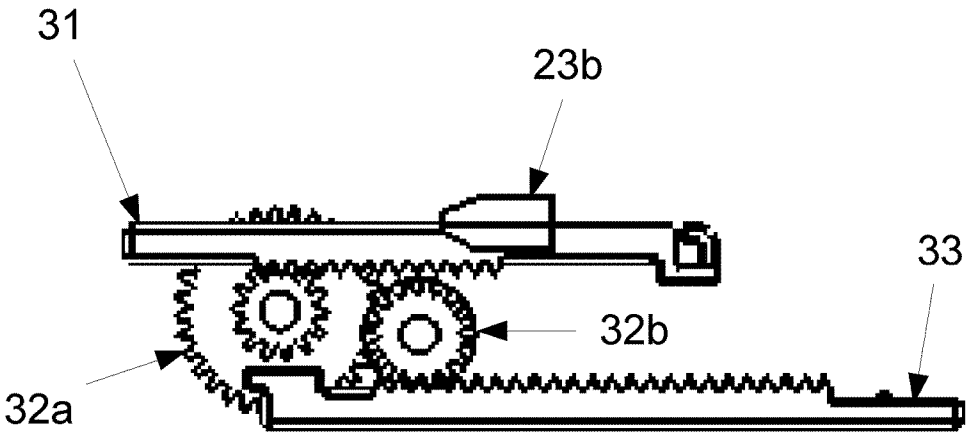
FIG. 3*a* is a side view of the gear assembly in the first position
Figure 3B:
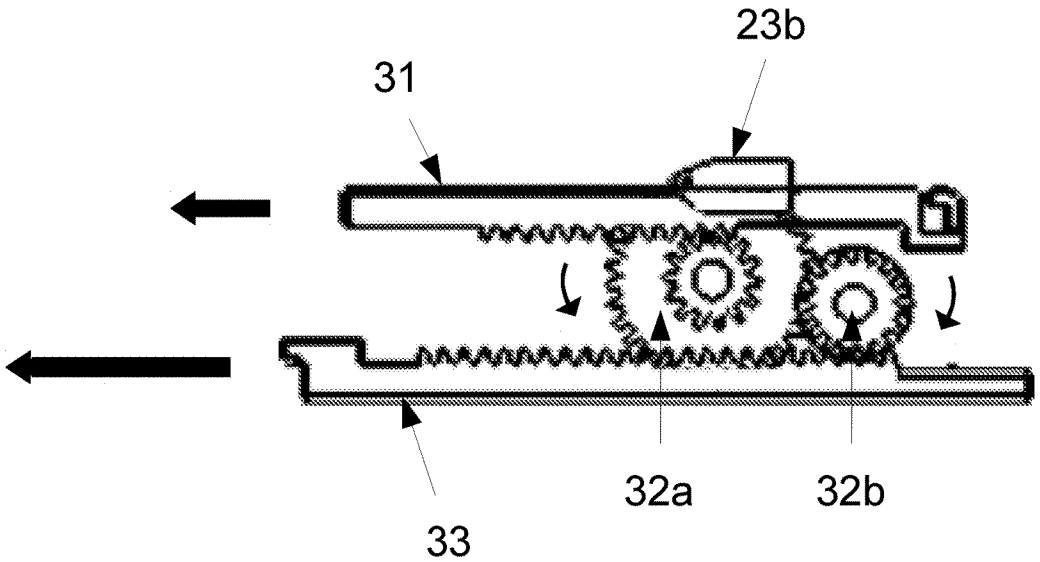
FIG. 3*b* is a side view of the gear assembly in the second position

In this particular embodiment of the present hand cutter, the gear assembly 30 comprises a top gear rack 31, two spur gears 32 and a bottom gear rack 33 (FIGS. 3*a-b*). Both top gear rack 31 and bottom gear rack 33 are slidable between a first position at the rear of the hand cutter (FIG. 3*a*) and a second position towards the front of the hand cutter (FIG. 3*b*). The top gear rack 31 features a rack protrusion 23*b* which is coupled with the arm protrusion 23*a* of the lever arm 22 of the actuator assembly 20 in the retracted position. The cogs on the top gear rack 31 interlock with the smaller rim of the first spur gear 32*a*. The first gear wheel 32*a* has a second rim which is larger than the first rim order to enable a gear ratio larger than 1 to be transmitted to the second gear wheel 32*b*. The larger second rim of the first gear wheel 32*a* interlocks with the rim of the second gear wheel 32*b* which rotates in the opposite direction than the first gear wheel 32*a*. The rim of the second gear wheel 32*b* also interlocks with the cogs on the bottom gear rack 33, which in turn moves in the same direction as the top gear rack 31, however by a larger distance (FIG. 3*b*). Thus, the top gear rack 31 and the bottom gear rack 33 are always simultaneously in their first or second position which, for simplicity, will hereinafter be called first and second gear assembly positions. If the transmission ratio achieved by the size differences between the smaller and larger rims of the first gear wheel 32*a* is not large enough, the second gear wheel 32*b* can also be equipped with two rims of different dimensions. In such an embodiment, the rim interlocking with the first gear wheel 32*a* is smaller than the rim interlocking with the bottom gear rack 33. The transmission ratios achieved in this way can vary between 1 and 2.

Figure 4:
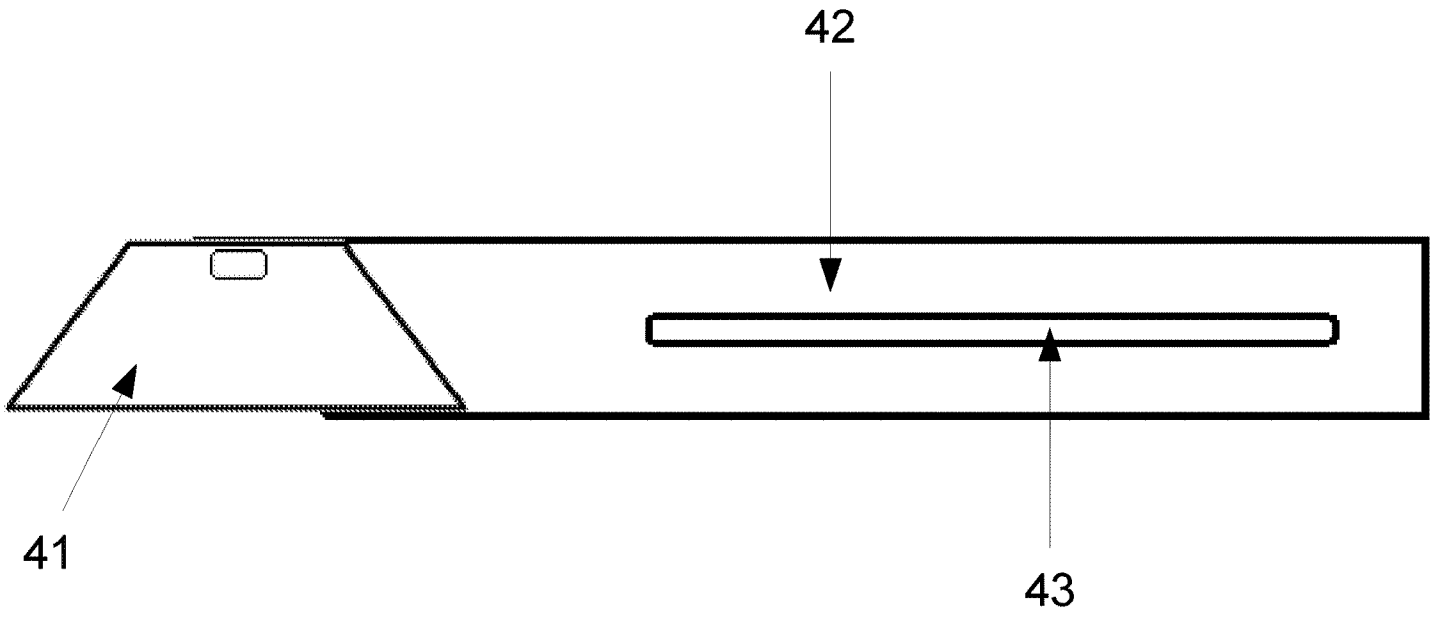
FIG. 4 is a side view of the blade assembly

In the preferred embodiment of the present hand cutter, the blade assembly 40 comprises a blade 41, a blade slide 42 and a blade holder (not shown), FIG. 4. The blade slide 42 is provided with a guiding groove 43 slidably engaging with the arm knob 25 of the lever arm 22 of the actuator assembly.

Figure 5A:
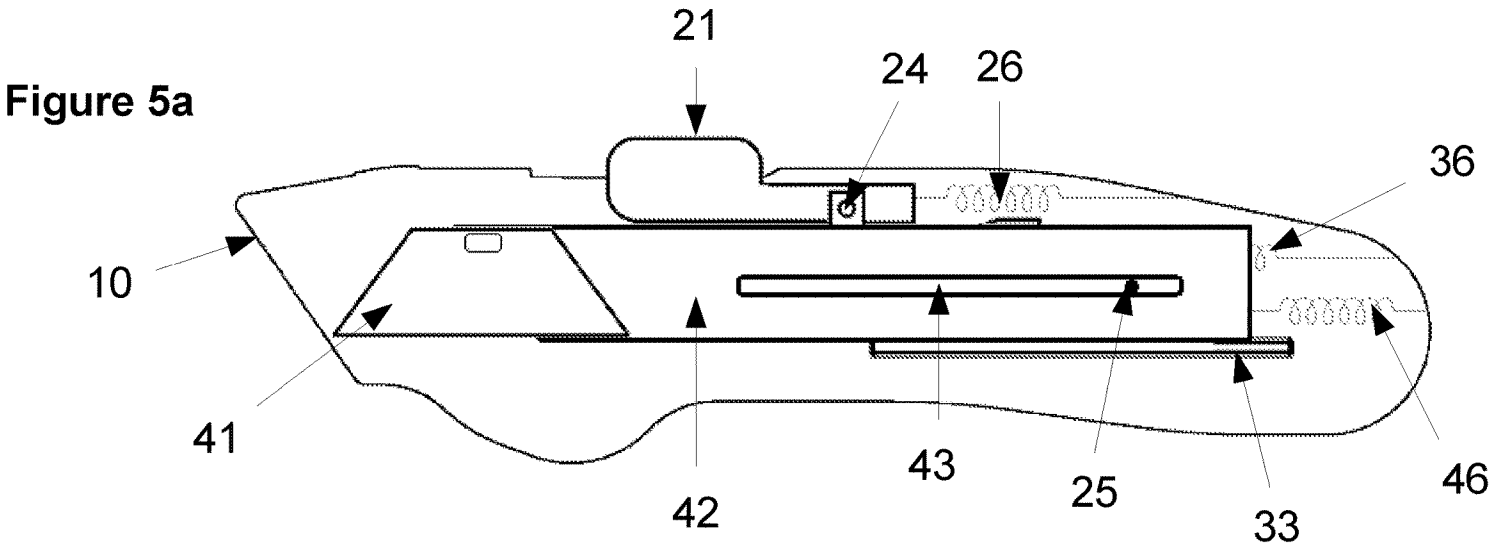
FIG. 5*a* is a side view of the inside of the hand cutter in the retracted position
Figure 5B:
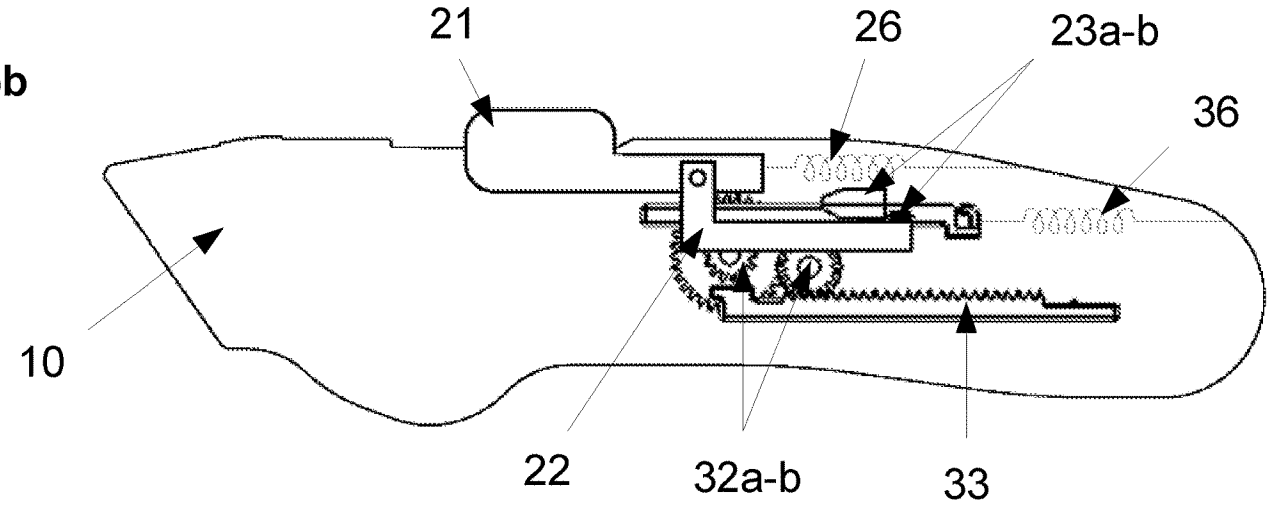
FIG. 5*b* is a side view of the inside of the hand cutter in the retracted position without the blade assembly

FIG. 5*a* shows the actuator assembly 21, gear assembly 33 and blade assembly 41,42,43 within the housing 10 in their first, respectively retracted position according to the particular embodiments described above. In FIG. 5*b*, the blade assembly is removed in order to show the actuator assembly 21,22,23*a-b* and the gear assembly 32*a-b*,33 more clearly. It is important that the actuator assembly 21,22,23*a-b*, gear assembly 32*a-b*,33 and blade assembly 41,42,43 should be permanently forced towards their first, respectively retracted positions at the rear of the hand cutter to enable them to return back to these positions automatically as soon as they are not forced into the second, respectively extended positions anymore. This is achieved by a set of retraction means which may comprise magnets or in an alternate embodiment springs. A combination of magnets or springs is also foreseen in alternate embodiments. In the preferred embodiment the gear assembly 30 is forced into its first position by a gear spring 36, the blade assembly is forced towards its retracted position by a blade spring 46 and the actuator assembly is forced towards its first position by an actuator spring 26. In the embodiment shown in FIGS. 5*a-b*, the gear spring 36 is connected to the top gear rack 31, the blade spring 46 to the blade slide 42 and the actuator spring 26 to the actuator slide 21. In alternative embodiments, these springs could be connected to other elements of the actuator assembly, of the gear assembly and of the blade assembly respectively. Since all the elements of one assembly are connected together, in particular by the pivot point 24 in the case of the actuator assembly, by the interlocking cogs in the case of the gear assembly and by the blade holder in the case of the blade assembly, it is sufficient to have at least one element of each of these assemblies forced towards the first, respectively retracted position to force all elements of the respective assembly into this position. For example, in the case of the gear assembly, the gear spring 36 may be connected to the bottom gear rack 33. Alternatively, the gear retraction means 36 may be a spiral spring or a torsion spring arranged around the axis of rotation of one of the spur gears 32.

Figure 6A:
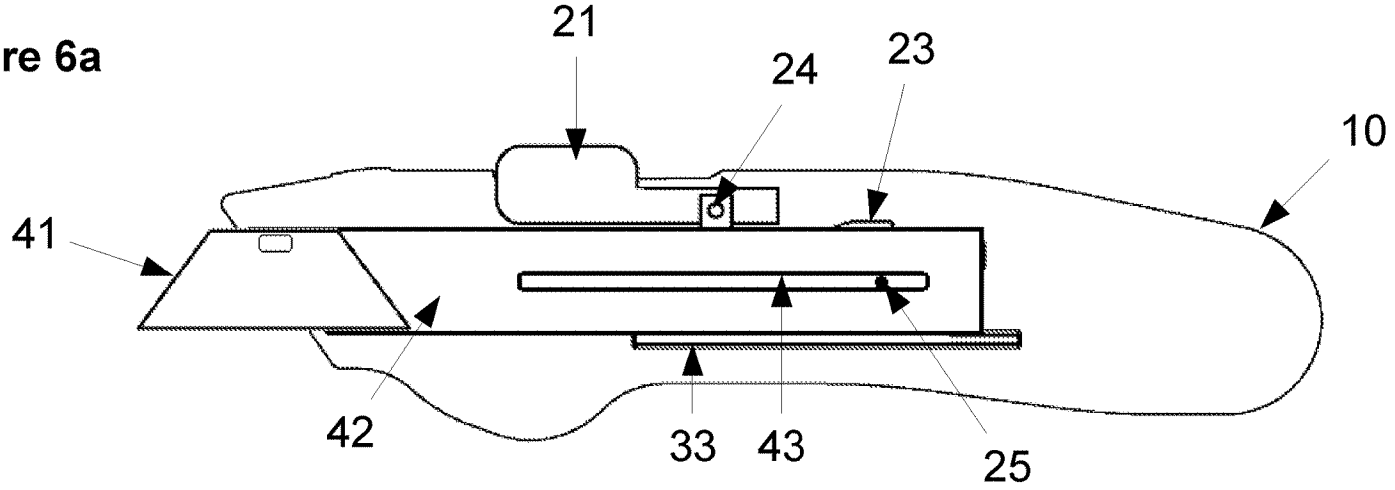
FIG. 6*a* is a side view of the inside of the hand cutter in the first extended position
Figure 6B:
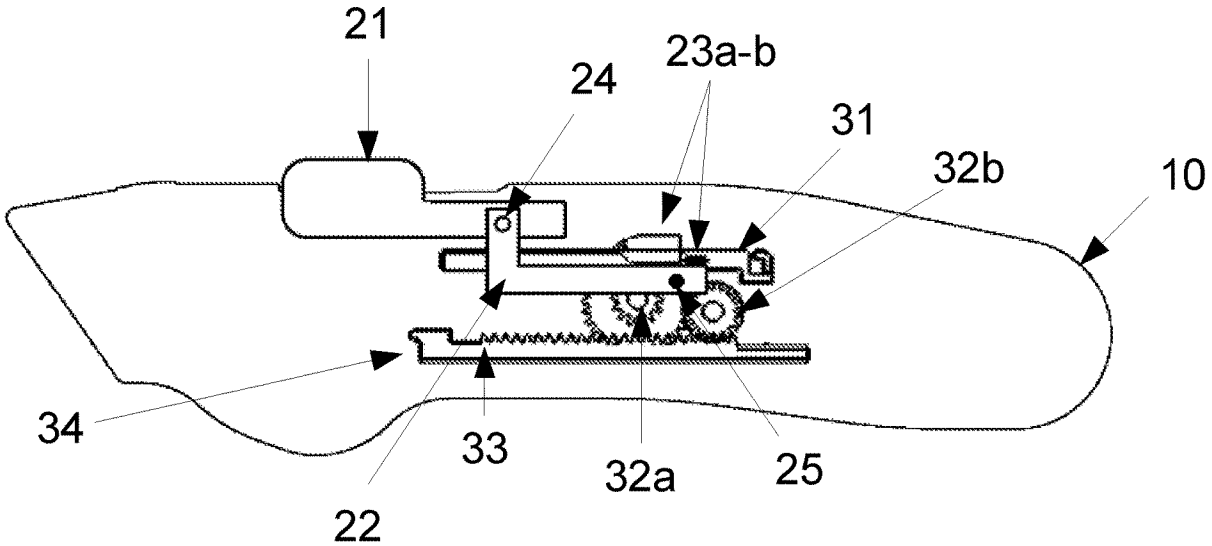
FIG. 6*b* is a side view of the inside of the hand cutter in the first extended position without the blade assembly

The FIGS. 6*a-b* show the same elements as FIGS. 5*a-b*, in their second, respectively first extended position. The forward movement from FIGS. 5*a-b* to FIGS. 6*a-b* occurs when a user pushes the actuator slide 21 forward with a thumb or another finger. The forward movement of the actuator slide 21 from its first to its second position is then:

- transmitted from the actuator slide 21 to the lever arm 22 via the pivot point 24;
- transmitted from the lever arm 22 to the top gear rack 31 via the first coupling means 23;
- transmitted from the top gear rack 31 to the spur gears 32 via the interlocking cogs of the top gear rack 31 and of the spur wheels 32;
- amplified by the gear ratio of the spur gears 32;
- transmitted from the spur wheels 32 to the bottom gear rack 33 via the interlocking cogs of the spur wheels 32 and of the bottom gear rack 33;
- transmitted from the bottom gear rack 33 to the blade slide via the second coupling means 34;
- extending the blade 41 out of the housing 10

In a particular embodiment of the hand cutter, the first coupling means 23 may comprise an arm protrusion 23*a* arranged on the lever arm 22 of the blade assembly engaging with a rack protrusion 23*b* arranged on the top gear rack 31 (FIGS. 5*b* and 6*b*). This arm protrusion 23*a* pushes the rack protrusion 23*b* and the top gear rack 31 forward when the lever arm 22 is moved forward. Other variations of the first coupling means 23 including but not limited to arranging the arm protrusion 23*a* on the lower part and the rack protrusion 23*b* on the upper part of the top gear rack 31 as well as arranging these elements horizontally instead of vertically beside each other are also possible.

Similarly, in a possible embodiment, the second coupling means 34 consists of the front part of the bottom gear rack 33 abutting against the rear end of blade slide 42, where the front is understood as the blade end of the hand cutter. Alternately a set of engaging protrusions as described above for the first coupling means can be attached to the bottom gear rack 33 and blade slide 42 respectively, so that a forward movement of the bottom gear rack 33 towards the second position pushes the blade slide 42 towards its first extended position.

Figure 7A:
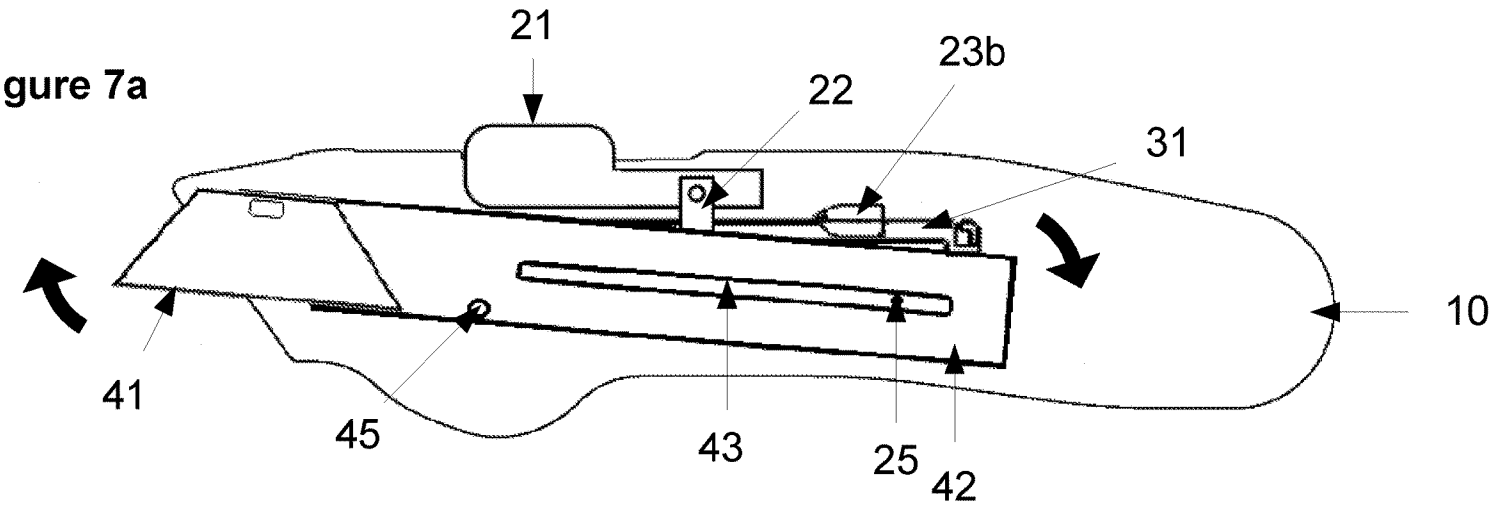
FIG. 7*a* is a side view of the inside of the hand cutter in the second extended position
Figure 7B:
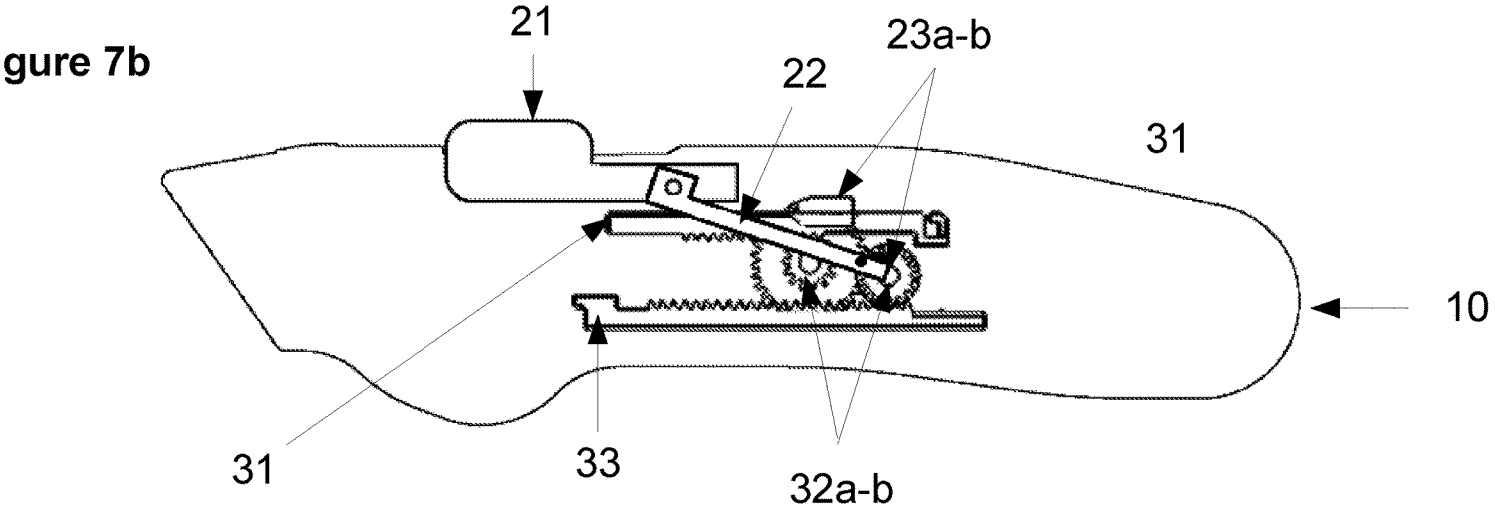
FIG. 7*b* is a side view of the inside of the hand cutter in the second extended position before retraction of the gear assembly and of the actuator assembly, without the blade assembly
Figure 7C:
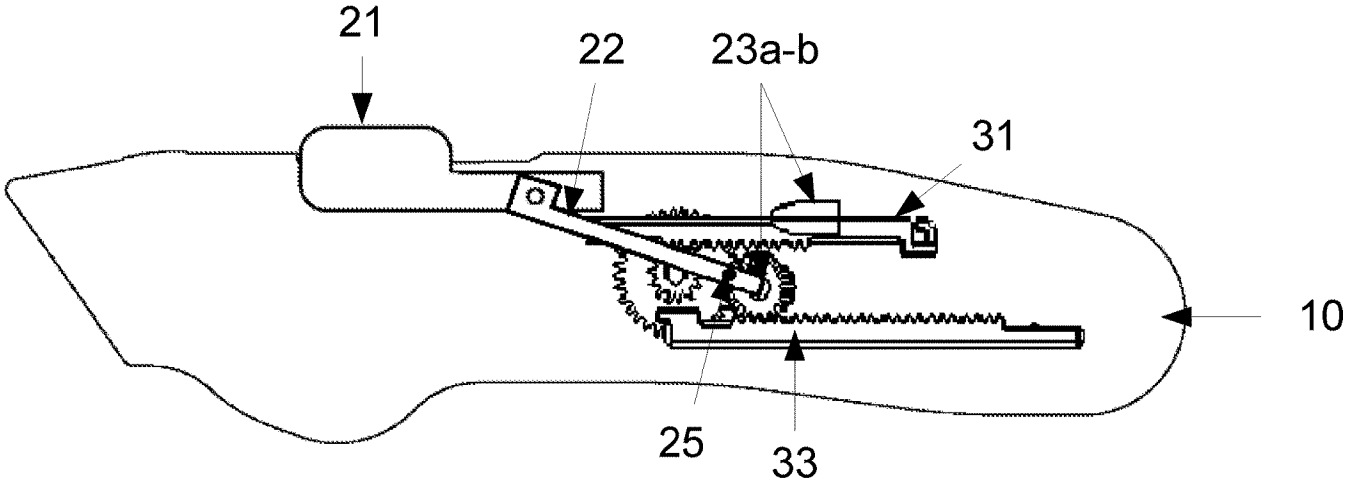
FIG. 7*c* is a side view of the inside of the hand cutter in the second extended position after retraction of the gear assembly and before retraction of the actuator assembly, without the blade assembly
Figure 7D:
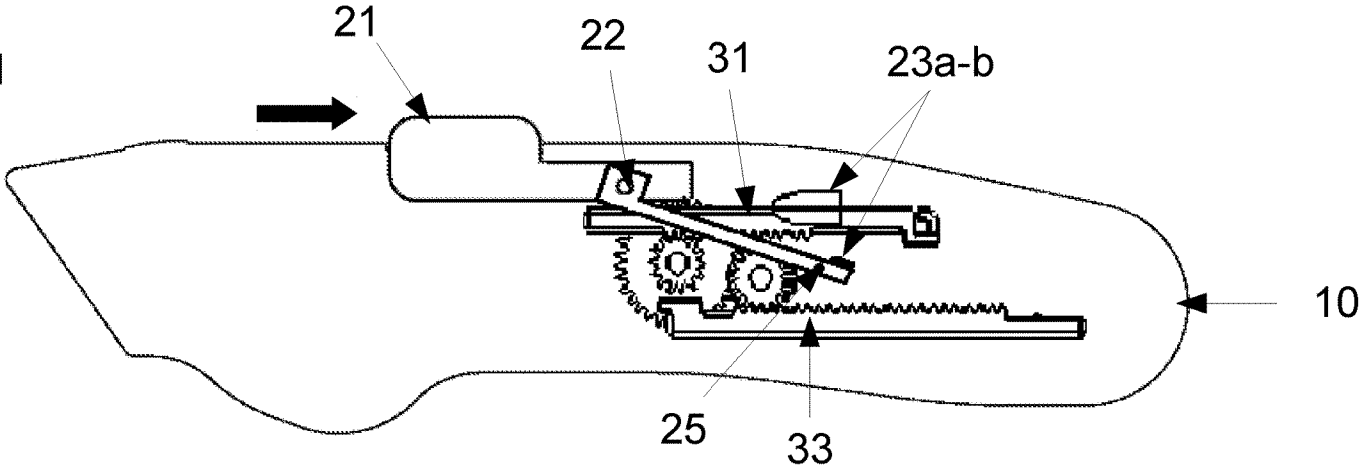
FIG. 7*d* is a side view of the inside of the hand cutter in the second extended position after retraction of the gear assembly and of the actuator assembly, without the blade assembly

When the blade 41 of the hand cutter is forced into a material to perform a cut, an upward force is exerted on the blade. This causes the rotation of the blade assembly 40 from the first extended position to the second extended position around a pivot point 45 located along the blade slide 42 (FIG. 7*a*). The pivot point 45 is formed by a knob which slides in a longitudinal guide arranged on the inner side of the housing when the blade assembly is moved between the retracted and first extended blade assembly positions. In the particular embodiment of FIG. 7*a*, the pivot point 45 is located roughly in the middle of the blade assembly 40, thus causing the rear part of the blade slide 42 to rotate downwards by approximately the same amount as the front part of the blade slide 42, holding the blade 41, rotates upwards. By moving the position of the pivot point 45 towards the front on the blade slide 42 the relative movement of the rear part of the blade slide 42 can be decreased and vice versa if this is desired. The downward rotation of the rear part of the blade slide 42 pulls the lever arm 22 downwards as well via the arm knob 25, which is arranged in the guiding groove 43 (FIG. 7*a*). In a different embodiment of the present hand cutter, the pivot point 45 may be located at the rear of the blade slide 42, thus causing the entire blade slide 42 to rotate upwards with the blade 41 when a cut is performed. In this embodiment, the groove 43 and the arm knob 25 push the lever arm 22 upwards, which is desirable if the first coupling means is implemented accordingly. In any case, the rotation of the blade slide 42 rotates the lever arm 22 away from the top gear rack 31 in order to disengage the first coupling means 23 (FIG. 7*b*).

An essential feature of the present hand cutter is that the second coupling means 34 between the bottom gear rack 33 and the blade slide 42 does not prevent the retraction of the bottom gear rack 33, so that the disengagement of the first coupling means 23 allows the gear assembly 30 to automatically return into its first position at the rear of the hand cutter as a result of the gear retraction means 36, thereby disengaging the second coupling means 34 as well. With the disengagement of the second coupling means 34, the blade assembly 40 is free to move back from the second extended position back to the retracted position as a result of the blade retraction means 46. It is important that the force of the blade retraction means 46 is carefully selected so that the friction force between the blade 41 and the material being cut is strong enough to prevent the blade assembly 40 from being removed from the second extended position during the cut by the force of the retraction means. Then, as soon as the cut is completed and the blade 41 is lifted from the material to cut, the blade retraction means 46 automatically retracts the blade assembly 40 into the retracted position. The simultaneous disengagement of the first coupling means 23 between the actuator assembly 20 and the gear assembly 30 and the second coupling means 34 between the gear assembly 30 and the blade assembly 40 has several advantages. First, decoupling the actuator assembly 20 from the gear assembly 30 prevents the user from blocking the blade assembly 40 in the first or second extended position even if he keeps pushing the actuator slide 21 forward. This ensures that the blade is only uncovered until it is used for performing a cut, thus minimizing the risk of injuries. Second, if the gear assembly 30 is not decoupled from the blade assembly it would be difficult to calibrate the force the blade retraction means 46 and the gear retraction means 36 exert onto the blade assembly 40 and the gear assembly respectively to ensure that the blade is not retracted during the cut. It is much easier to implement if only one part, e.g. the blade retraction means 46 must be selected such that the blade retraction means 46 does not create a larger force than the friction force while performing the cut.

Figure 8:
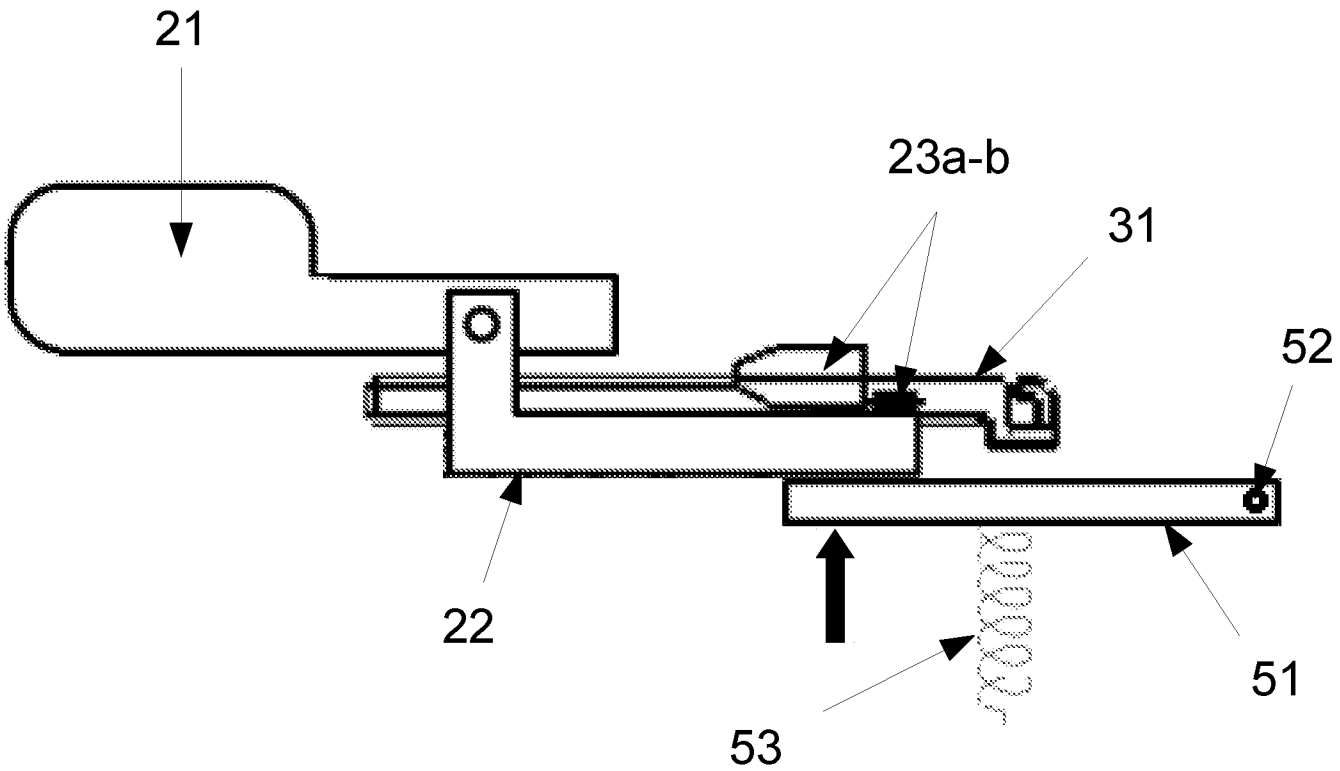
FIG. 8 is a side view of the actuator assembly and of the means for reengaging the first coupling means

In a particular embodiment of the present invention, the hand cutter is provided with means 51,52 for reengaging the first coupling means 23 between the actuator assembly 21,22,23*a-b* and the gear assembly 31 as soon as the actuator assembly, the gear assembly and the blade assembly have returned into their first, respectively retracted position (FIG. 8). These means for reengaging comprise a pushing member 51 whose role is to push the lever arm 22 towards the top gear rack 31, thereby reengaging the first coupling means 23 as in the initial state (FIG. 5*b*). As shown in FIG. 8, the pushing member may be pivotally fixed to the blade slide (not shown for clarity) at a pivot point 52 and forced towards the lever arm by an arm pushing means 53 whose other end is also fixed to the blade slide 42. This arm pushing means 53 may comprise at least one spring or at least one magnet.

Figure 9A:
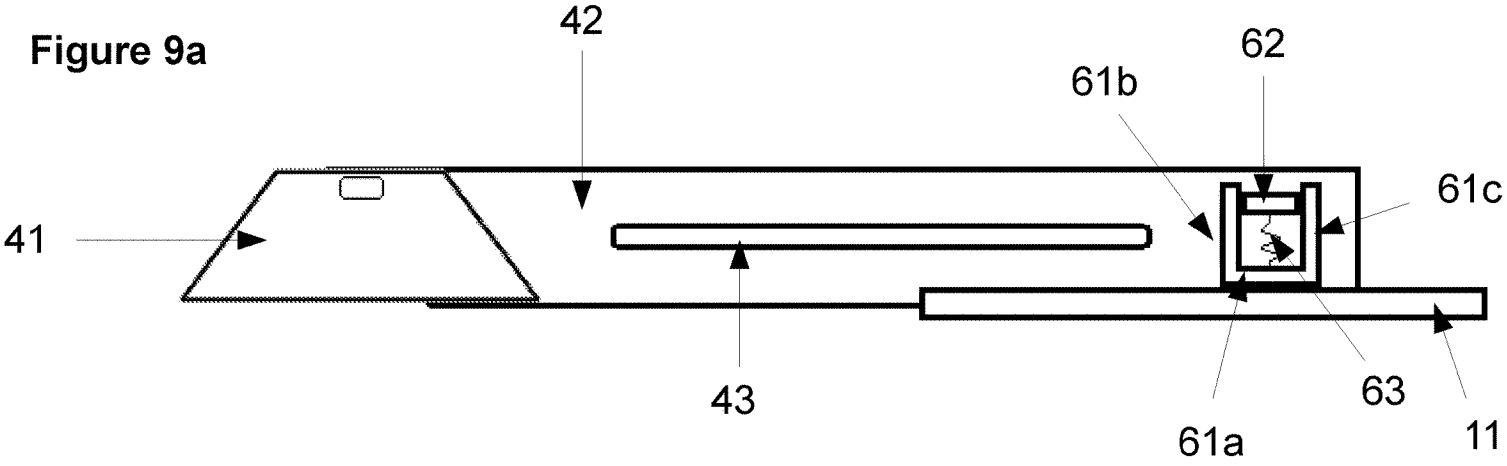
FIG. 9*a* is a side view of the blade assembly and of the stabilization assembly
Figure 9B:
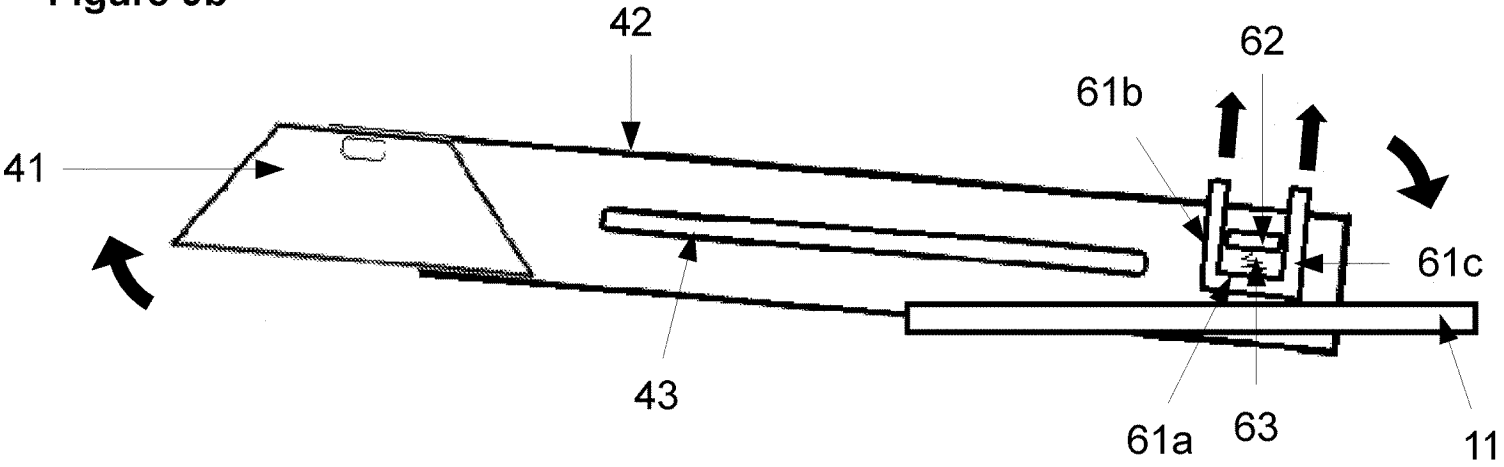
FIG. 9*b* is a side view of the blade assembly and of the stabilization assembly in the second extended position

In yet another embodiment of the present invention, the hand cutter is provided with a stabilization assembly 60 whose role is to force the rotation of the blade assembly 40 from its second extended position (FIG. 7*a*) back to its retracted position (FIG. 5*a*) and to prevent an accidental rotation of the blade assembly 40. The stabilization assembly consists of a sliding member 61, a stabilizer knob 62 and a stabilizer pushing means 63 (FIGS. 9*a-b*). The stabilizer knob 62 is arranged on the blade slide 42 and may be integral with the blade slide 42. The sliding member 61 features a bottom sliding region 61*a* adapted to slide on a longitudinal guiding ridge 11 arranged on the inner side of the housing 10 when the blade assembly moves within the housing 10 between the retracted and the first extended position. Thus, the ridge 11 acts as a guide for the movement of the blade assembly 40 and the sliding member 61 as a stabilizer thereof. The sliding member 61 is connected to the stabilizer knob 62 via a stabilizer pushing means 63 which pushes the sliding member 61 away from the stabilizer knob 62. In possible embodiments of the hand cutter, the pushing means 63 may comprise at least one spring or at least one magnet. With the arrangement the blade assembly 40 is stabilized so that it does not rotate accidentally until the blade is used for performing a cut which requires a considerable force. As soon as the blade 41 is forced into a material being cut and the blade assembly 40 rotates from its first extended position to its second extended position as shown FIG. 7*a*, the sliding region 61*a* of the sliding member abuts against the longitudinal guiding ridge 11 arranged on the inner side of the housing 10, thus compressing the stabilizer pushing means 63 against the stabilizer knob 62 (FIG. 9*b*). As soon as the blade is removed from the material being cut, the stabilizer pushing member 63 rotates the blade assembly 40 from its second extended position towards its first extended position (FIG. 9*a*) while at the same time the blade retraction means 46 forces the blade assembly back to the retracted position. This ensures that the slide assembly 40 returns to its original retracted position, which is not rotated as the second extended position. In the particular embodiment shown in FIGS. 9*a-b*, the sliding member 61 is U-shaped, with two side arms 61*b-c* which are adapted to slide on either side of the stabilizer knob 62 when the sliding member 61 abuts against the longitudinal guiding ridge 11. Another feature of the stabilization assembly 60 is that it allows the control of the cutting force needed for pivoting the blade assembly 40 from the first extended position to the second extended position and subsequently disengaging the first coupling means 23. In a possible embodiment of the hand cutter, the stabilization assembly is provided with means for adjusting the force of the pushing means 63, e.g. with a dial.

In a further embodiment of the hand cutter, the housing 10 is provided with a hump 12 located at the bottom front of the hand cutter, between the blade 41 and the region where the users fingers are usually located when he grasps the hand cutter (FIG. 1*a*). This shields the users fingers from a potential contact with the blade 41 and also contributes to minimize the risk of injuries.

The invention claimed is:

1. A hand cutter comprising
a housing
a blade assembly
slidable within the housing between a retracted and a first extended position,
with a blade,
a blade slide
a blade holder in the front part of said blade slide holding said blade,
an actuator assembly
slidable along said housing between a first and a second position with an actuator slide,
a gear assembly,
attached to the inner side of the housing,
with a top gear rack slidable between a first and a second position,
two or more interconnected spur gears,
a bottom gear rack slidable between a first and a second position,
a retraction means
forcing at least one of the blade, actuator or gear assemblies to the retracted or first position
wherein
the actuator assembly is coupled to the top gear rack by a first coupling means,
the bottom gear rack is coupled to the blade assembly by a second coupling means,
the first of said spur gears engages with the top gear rack
the last of said spur gears engages with the bottom gear rack,
in such a manner that a movement of said actuator slide is transmitted to said blade assembly via said gear assembly,
the gear ratio of said gear assembly is such that moving said actuator slide moves said blade assembly by a larger distance.

2. A hand cutter according to claim 1,
wherein
said first coupling means can be decoupled,
said second coupling means can be decoupled and,
said retraction means consists of
a blade retraction means permanently forcing the blade assembly to the retracted position,
an actuator retraction means permanently forcing the actuator assembly to the first position,
a gear retraction means permanently forcing the gear assembly to the first position.

3. A hand cutter according to claim 2
wherein
said actuator assembly includes
a pivotable lever arm connected to said actuator slide by a pivot point,
said top gear rack is connected to said lever arm by first coupling means,
said first coupling means consists of an arm protrusion arranged at the rear end of said lever arm abutting against a rack protrusion arranged on top of said top gear rack in such manner that the arm protrusion pulls the rack protrusion forward when the lever arm is moved from its first position towards its second position.

4. A hand cutter according to claim 2,
wherein
said second coupling means is formed by the front end of said bottom gear rack abutting on the rear end of said blade slide so that a forward movement of the bottom gear rack pushes the blade slide forward.

5. A hand cutter according to claim 2
wherein
a movement of said actuator slide and said lever arm from said first actuator position towards said second actuator position against the force of said actuator retraction means
moves said top gear rack from said first gear rack position towards said second gear rack position via said first coupling means and against the force of said gear retraction means,
said movement of the top gear rack makes the spur gears turn
said turning of the spur gears makes the bottom gear rack slide from the first bottom gear rack position towards the second bottom gear rack position and said movement of the bottom gear rack brings the blade slide from said retracted to said first extended position against the force of said blade retraction means.

6. A hand cutter according to claim 3,
wherein
a pivot point is arranged on the blade slide, allowing the blade to pivot within the housing from said first extended position to a second extended position in which the front part of the blade slide is pivoted upward and the rear part of the blade slide is pivoted downward,
said pivot point slides in a longitudinal guide arranged along the inner side of the housing when the blade assembly is moved between the retracted and first extended blade assembly position.

7. A hand cutter according to claim 6,
wherein
said blade slide has a guiding groove oriented in the direction of the sliding motion, said lever arm has an arm knob sliding in said guiding groove of the blade slide.

8. A hand cutter according to claim 7,
wherein
the action of pressing the cutting blade into a material rotates the blade slide between said first extended and said second extended position, said guiding groove of the blade slide pushing said arm knob of the lever arm, downwards thereby causing a rotation of said lever arm around said pivot point and leading the arm protrusion away from the rack protrusion, thus disengaging the first coupling means.

9. A hand cutter according to claim 2, wherein said gear retraction means forces the top gear rack back to the first top gear rack position as soon as the first coupling means are decoupled, thus sliding said bottom gear rack back to the second bottom gear rack position via the spur gears, said blade retraction means forces the blade slide back to the retracted position as soon as the cutting blade is removed from the material, said actuator retraction means forces the actuator slide back to the first actuator position as soon as the actuator is released.

10. A hand cutter according to claim 6, wherein a stabilization assembly connected to the blade slide and the inner side of the housing forcing the blade slide to rotate from the second extended position back to the first extended position.

11. A hand cutter according to claim 8, wherein the action of pressing the cutting blade into a material rotates the blade slide between said first extended and said second extended position, thereby decoupling the second coupling means.

12. A hand cutter according to claim 10, wherein said stabilization assembly comprises a stabilizer pushing means, one end of said stabilizer pushing means is connected to a stabilizer knob arranged on the blade slide while the other end of said stabilizer pushing means is connected to a sliding member which is abutting and sliding on a longitudinal guiding ridge on the inner side of the housing.

13. A hand cutter according to claim 12, wherein said sliding member has a U-shaped form.

14. A hand cutter according to claim 3 wherein the blade slide is provided with a pushing member, said pushing member is pivotally fixed to the blade slide, an arm pushing means forces the pushing member against said lever arm, thus ensuring that said lever arm and said top gear rack automatically recouple as soon as said actuator slide returns to the first actuator position and said top gear rack returns to the first top gear rack position.

15. A hand cutter according to claim 1, wherein, at least one of said spur gears consists of several tooth rims with variable diameters.

* * * * *